US005846384A

United States Patent [19]

Schöld et al.

[11] Patent Number: 5,846,384

[45] Date of Patent: Dec. 8, 1998

[54] PROCESS FOR THE PRODUCTION OF PAPER

[75] Inventors: Zaid Schöld, Värmdö ; Hans Johansson, Kungälv, both of Sweden

[73] Assignee: Eka Chemicals AB, Bohus, Sweden

[21] Appl. No.: 662,756

[22] Filed: Jun. 10, 1996

Related U.S. Application Data

[60] Provisional application No. 60/003,033 Jun. 20, 1995.

[30] Foreign Application Priority Data

Jun. 15, 1995 [SE] Sweden ..... 9502184

[51] Int. Cl.[6] ..... D21H 21/10

[52] U.S. Cl. ..... 162/175; 162/181.1; 162/181.2; 162/181.3; 162/181.5; 162/181.6; 162/181.8; 162/183

[58] Field of Search ..... 162/175, 181.6, 162/181.2, 181.3, 181.4, 181.1, 183, 181.8

[56] References Cited

U.S. PATENT DOCUMENTS

| | | | |
|---|---|---|---|
| 4,388,150 | 6/1983 | Sunden et al. | 162/175 |
| 4,753,710 | 6/1988 | Langley et al. | 162/164.3 |
| 4,927,498 | 5/1990 | Rushmere | 162/168.3 |
| 4,954,220 | 9/1990 | Rushmere | 162/168.3 |
| 4,961,825 | 10/1990 | Andersson et al. | 162/175 |
| 4,980,025 | 12/1990 | Andersson et al. | 162/168.3 |
| 5,071,512 | 12/1991 | Bixler et al. | 162/175 |
| 5,127,994 | 7/1992 | Johansson | 162/168.3 |
| 5,176,891 | 1/1993 | Rushmere | 423/328.1 |
| 5,279,807 | 1/1994 | Moffet et al. | 423/338 |
| 5,368,833 | 11/1994 | Johansson et al. | 423/338 |
| 5,447,604 | 9/1995 | Johansson et al. | 162/181.6 |
| 5,470,435 | 11/1995 | Rushmere et al. | 162/181.6 |

FOREIGN PATENT DOCUMENTS

| | | | |
|---|---|---|---|
| 0 357 574 A2 | 3/1990 | European Pat. Off. | D21H 23/76 |
| WO/94/05595 | 3/1994 | WIPO | C01B 33/14 |
| WO/94/05596 | 3/1994 | WIPO | C01B 33/143 |
| WO/95/23021 | 8/1995 | WIPO | B01J 13/00 |

*Primary Examiner*—Peter Chin
*Attorney, Agent, or Firm*—Ralph J. Mancini

[57] ABSTRACT

A process for the production of paper from a suspension of cellulose containing fibers, and optional fillers, which comprises adding an aluminum compound and anionic inorganic particles to the suspension, forming and draining the suspension on a wire, wherein the aluminum compound and anionic inorganic particles are mixed immediately prior to addition to the suspension.

18 Claims, No Drawings

PROCESS FOR THE PRODUCTION OF PAPER

The present application claims priority of Swedish Patent Application No. 9502184-6 filed on Jun. 15, 1995 and benefit of U.S. Provisional Application No. 60/003,033 filed Jun. 20, 1995.

The present invention relates to a process for the production of paper and more particularly to a process in which a freshly prepared mixture of an aluminum compound and anionic inorganic particles are added to a papermaking stock in order to improve drainage and retention.

It is well-known in the papermaking art to use additive systems of drainage and retention aids consisting of two or more components which are added to the stock in order to facilitate drainage and to increase adsorption of fine particles onto the cellulose fibers so that they are retained with the fibers. Systems comprising aluminum compounds and anionic inorganic particles are well-known and usually these components are used in conjunction with organic polymers, in particular cationic polymers. Examples of anionic inorganic particles widely used as for drainage and retention purposes include silica-based particles and smectite clays, which have proved to be very efficient.

The components of drainage and retention aid systems are normally added separately to the stock. It is further known to use drainage and retention aids comprising reaction products of aluminum compounds and anionic inorganic particles. U.S. Pat. Nos. 4,927,498 and 5,368,833 disclose aluminum-modified silica particles obtained by reaction of silica particles with aluminates. The latter patent discloses that the effect of drainage and retention aids comprising cationic polymer and aluminum-modified silica particles is enhanced when there is also added to the stock an additional aluminum compound, e.g. any of those conventionally used in papermaking.

According to the present invention it has been found that it is possible to improve drainage and/or retention in papermaking by mixing an aluminum compound with anionic inorganic particles just prior to the addition to the stock. More specifically, the present invention relates to a process for the production of paper from an aqueous suspension of cellulose-containing fibers, and optional fillers, which comprises adding an aluminum compound and anionic inorganic particles to the suspension, forming and draining the suspension on a wire, wherein the aluminum compound and anionic inorganic particles are mixed immediately prior to the addition to the suspension. The invention thus relates to a process as further defined in the claims.

The process according to the present invention results in improved drainage and/or retention in papermaking as compared to processes in which the components are separately added to the stock as well as processes in which the components are reacted or mixed some time before the addition. Thus, by applying the present process the speed of the paper machine can be increased and lower dosage of the components can be used to give a corresponding effect, thereby leading to economic benefits and an improved papermaking process.

The process of the present invention comprises premixing the aluminum compound and anionic inorganic particles immediately prior to the addition to the stock. Hereby is meant that the contact time, i.e. the time from mixing these components to adding the mixture formed to the stock, should be as short as possible. Suitably, this period of time is less than 4 minutes and preferably less than 2 minutes. This can be effected by rapidly mixing an aqueous phase of aluminum compound with an aqueous phase of anionic inorganic particles and then incorporating the resulting aqueous mixture into the stock.

According to a preferred embodiment of the invention, an aqueous stream of aluminum compound is brought into contact with an aqueous stream of anionic inorganic particles, whereupon the resulting aqueous stream is introduced into the suspension. This can be effected by directing separate streams of the components to be mixed towards each other, allowing them to impinge on each other and introducing the mixture so formed into the stock. Suitably mixing is carried out under turbulent flow conditions which promotes more intensive and rapid mixing of the streams. The streams can be mixed by means of any mixing device having at least two inlets into which separate streams of the components to be mixed are supplied and having at least one outlet through which the resulting mixture is passed and subsequently introduced into the stock. By applying the stream mixing process, in particular when using a mixing device of the above-mentioned type, the components of the resultant stream can be brought into intimately contact for a period of time less than one minute prior to the incorporation into the stock, which has been found to be very effective, especially contact times of less than about 30 seconds and suitable less than about 15 seconds. The stream mixing embodiment is further advantageous from a practical point of view and confers operational benefits. Mixing devices that can be used to carry out the present process are known in the art, even though intended for other types of components and for other purposes. For example, use can be made of mixing pipes that are essentially Y or T shaped, whereby the discrete streams of the components can be passed in essentially opposite directions in order to impinge on each other, whereupon the resultant mixture is passed into the stock. Differently shaped mixing pipes as well as static mixers can also be used.

Anionic inorganic particles that can be used according to the invention include silica-based particles, clays of the smectite type, and mixtures thereof. It is preferred that the particles are in the colloidal range of particle size. Silica-based particles, i.e. particles based on $SiO_2$, including colloidal silica, different types of polysilicic acid, colloidal aluminum-modified silica, colloidal aluminum silicate, and mixtures thereof, are preferably used, either alone or in combination with other types of anionic inorganic particles. Suitable silica-based particles and methods for their preparation are disclosed in U.S. Pat. Nos. 4,388,150; 4,954,220; 4,961,825; 4,980,025; 5,127,994; 5,368,833; and 5,447,604 as well as International Patent Publications WO 94/05596 and WO 95/23021, which are all hereby incorporated herein by reference.

Silica-based particles suitably have a particle size below about 50 nm, preferably below about 20 nm and more preferably in the range of from about 1 to about 10 nm. The specific surface area of the silica-based particles is suitably above 50 $m^2/g$ and preferably above 100 $m^2/g$. Generally, the silica-based particles can have a specific surface area up to 1700 $m^2/g$. The colloidal silica suitably has a specific surface area up to 1000 $m^2/g$ and preferably up to 950 $m^2/g$. Suitably the colloidal aluminum-modified silica and colloidal aluminum silicate also have a specific surface area up to 1000 $m^2/g$ and preferably up to 950 $m^2/g$. The specific surface area can be measured by means of titration with NaOH according to the method described by Sears in Analytical Chemistry 28(1956):12, 1981–1983.

According to a preferred embodiment of the invention, the anionic inorganic particles are thus silica-based particles having a specific surface area within the range of from 50 to 1000 $m^2/g$ and preferably from 100 to 950 $m^2/g$. Suitable silica-based particles of this type are generally supplied in the form of aqueous sols, for example as disclosed in U.S. Pat. Nos. 4,388,150 and 4,980,025. The latter patent discloses sols comprising particles having at least a surface layer of aluminum silicate or aluminum-modified silicic acid containing silicon atoms and aluminum atoms in a ratio of from 9.5:0.5 to 7.5:2.5.

According to another preferred embodiment of the present invention, use is made of a silica sol having an S-value in the range of from 8 to 45%, preferably from 10 to 30%, containing silica particles having a specific surface area in the range of from 750 to 1000 $m^2/g$, preferably from 800 to 950 $m^2/g$, which are surface-modified with aluminum to a degree of from 2 to 25% substitution of silicon atoms, as disclosed in U.S. Pat. No. 5,368,833. The S-value can be measured and calculated as described by Iler & Dalton in J. Phys. Chem. 60(1956), 955–957. The S-value indicates the degree of aggregate or microgel formation and a lower S-value is indicative of a higher degree of aggregation.

According to another preferred embodiment of the present invention, use is made of a polysilicic acid having a high specific surface area, suitably above about 1000 $m^2/g$. In the art, polysilicic acid is also referred to as polymeric silicic acid, polysilicic acid microgel and polysilicate microgel, which are all encompassed by the term polysilicic acid. Suitably the polysilicic acid have a specific surface area within the range of from 1000 to 1700 $m^2/g$ and preferably from 1050 to 1600 $m^2/g$. Polysilicic acids that can be used according to the present invention include those disclosed in U.S. Pat. Nos. 4,388,150; 4,954,220; and 5,127,994.

The polysilicic acid can be prepared by acidifying a dilute aqueous solution of alkali metal silicate, such as potassium or sodium water glass, preferably sodium water glass, which suitably contains about 0.1 to 6% by weight of $SiO_2$. Acidification can be carried out in many ways, for example by using acid ion exchange resins, mineral acids, e.g. sulphuric acid, hydrochloric acid and phosphoric acid, acid salts or acid gases, suitably ion-exchangers or mineral acids or a combination thereof. Where more stable polysilicic acids are desired, it is preferred to use acid ion-exchangers. The acidification is suitably carried out to a pH within the range of from 1 to 11 and preferably to a pH within the acid range of from 2 to 4. According to another preferred aspect of the invention, partial acidification is carried out to a pH of from about 7 to 10, thereby forming a polysilicic acid which is usually termed activated silica. In comparison with sols comprising silica-based particles of lower specific surface area, aqueous polysilicic acids are usually considerably less stable. Due to this, polysilicic acids should not be stored for too long times but a certain aging, e.g. for a day or a couple of days at a concentration of not more than about 4 to 5% by weight, can result in an improved effect. In accordance with another preferred embodiment of the invention, the aqueous polysilicic acid to be used is produced at the location of intended use. This mode of operation can be applied in the whole acidified pH range of 1 to 11, even when using less stable polysilicic acids in the pH range of 4 to 7 which usually gel rapidly.

Clays of the smectite type that can be used in the process of the present invention are known in the art and include naturally occurring, synthetic and chemically treated materials. Examples of suitable smectite clays include montmorillonite/bentonite, hectorite, beidelite, nontronite and saponite, preferably bentonite and especially such which after swelling preferably has a surface area of from 400 to 800 $m^2/g$. Suitable bentonites and hectorites are disclosed in U.S. Pat. Nos. 4,753,710 and 5,071,512, respectively, which are hereby incorporated herein by reference. Suitable mixtures of silica-based particles and smectite clays, preferably natural bentonites, are disclosed in International Patent Publication WO 94/05595 which is likewise incorporated herein by reference, where the weight ratio of silica-based particles to clay particles can be within the range of from 20:1 to 1:10, preferably from 6:1 to 1:3.

Aluminum compounds that can be used in the process of the invention are known in the art and include alum, aluminates, aluminum chloride, aluminum nitrate and polyaluminum compounds, such as polyaluminum chlorides, polyaluminum sulphates, polyaluminum compounds containing both chloride and sulphate ions, polyaluminum silicate-sulphates, and mixtures thereof. The polyaluminum compounds may also contain other anions, for example anions from phosphoric acid, organic acids such as citric acid and oxalic acid. Suitable aluminum compounds are disclosed in U.S. Pat. No. 5,127,994. According to a preferred embodiment of the invention, the aluminum compound is an aluminate, e.g. sodium or potassium aluminate, preferably sodium aluminate. According to another preferred embodiment of the invention, use is made of an acid aluminum compound which thus can be selected from alum, aluminum chloride, polyaluminum compounds and mixtures thereof.

The pre-mix used in the present process can be formed by admixing the anionic inorganic particles with aluminum compound in a weight ratio within the range of from 100:1 to 1:1. Suitably the weight ratio anionic inorganic particles to aluminum compound is within the range from 50:1 to 1.5:1 and preferably from 20:1 to 2:1.

The amount of anionic inorganic particles added to the suspension may vary within wide limits depending on, for example, the type of particles used. The amount is usually at least 0.01 kg/ton, often at least 0.05 kg/ton, calculated as dry particles on dry fibers and optional fillers. The upper limit can be 10 and suitably is 5 kg/ton. When using silica-based particles, the amount suitably is within the range of from 0.05 to 5 kg/ton, calculated as $SiO_2$ on dry stock system, preferably within the range of from 0.1 to 2 kg/ton.

The amount of aluminum compound added to the suspension may depend on the type of aluminum compound used and on other effects desired from it. It is for instance well-known in the art to utilize aluminum compounds as precipitants for rosin-based sizes. The amount of aluminum compound mixed with the anionic organic particles to form the pre-mix and subsequently added to the stock should suitably be at least 0.001 kg/ton, calculated as $Al_2O_3$ on dry fibers and optional fillers. Suitably the amount is within the range of from 0.01 to 1 kg/ton and preferably within the range from 0.05 to 0.5 kg/ton. If required, additional aluminum compounds can be added to the stock at any position prior to draining. Examples of suitable additional aluminum compounds include those defined above.

The concentrations of the aqueous phases of aluminum compound and anionic inorganic particles to be mixed according to the invention can be varied over a broad range and may depend on the type of components used. Solutions of aluminum compound can have a concentration of at least 0.01% by weight, calculated as $Al_2O_3$, and the upper limit is usually about 25% by weight. Suitably the concentration is within the range of from 0.1 to 10 and preferably from 0.2 to 5% by weight. Aqueous phases of anionic inorganic particles to be used for mixing can have a concentration of at least 0.01% by weight, and the upper limit is usually about 20% by weight. Suitably the amount is within the range of from 0.1 to 15 and preferably from 0.5 to 10% by weight. The freshly prepared mixture, the pre-mix, can have a dry content of at least 0.01% by weight, and the upper limit is usually about 20% by weight. Suitably the dry content is within the range of from 0.05 to 10 and preferably from 0.1 to 5% by weight.

The freshly prepared mixture of aluminum compound and anionic inorganic particles according to the invention is preferably used in conjunction with at least one organic polymer acting as a drainage and/or retention aid which can be selected from anionic, amphoteric, nonionic and cationic polymers and mixtures thereof. The use of such polymers as drainage and/or retention aids is well-known in the art. Suitably at least one cationic or amphoteric polymer is used, preferably cationic polymer. The polymers can be derived from natural or synthetic sources, and they can be linear or branched. Examples of suitable polymers include anionic, amphoteric and cationic starches, guar gums and acrylamide-based polymers, as well as poly(diallyldimethyl ammonium chloride), polyethylene imines, polyamines, polyamidoamines, melamine-formaldehyde and urea-formaldehyde resins. Cationic starch and cationic polyacrylamide are particularly preferred polymers. When using the pre-mix of the present process in combination with an organic polymer as mentioned above, it is further preferred to use at least one anionic trash catcher (ATC). ATC's are known in the art as neutralizing agents for detrimental anionic substances present in the stock. Hereby ATC's can enhance the efficiency of the components used in the present process. Thus, further suitable combinations of polymers that can be co-used with the pre-mix of the present invention include ATC in combination with high molecular weight polymer, e.g. cationic starch and/or cationic polyacrylamide, anionic polyacrylamide as well as cationic starch and/or cationic polyacrylamide in combination with anionic polyacrylamide. Suitable ATC's include cationic polyelectrolytes, especially low molecular weight highly charged cationic organic polymers such as polyamines, polyethyleneimines, homo- and copolymers based on diallyldimethyl ammonium chloride, (meth) acrylamides and (meth) acrylates. Even if arbitrary order of addition can be used, it is preferred to add the polymer or polymers to the stock before the mixture of aluminum compound and anionic inorganic particles. Normally, ATC's are added to the stock prior to other polymers.

The amount of organic polymer can be varied over a broad range depending on, among other things, the type of polymer or polymers used and other effects desired from it. Usually, use is made of at least 0.005 kg of polymer per ton of dry fibers and optional fillers. For synthetic cationic polymers, such as for example cationic polyacrylamide, amounts of at least 0.005 kg/ton are usually used, calculated as dry on dry fibers and optional fillers, suitably from 0.01 to 3 and preferably from 0.03 to 2 kg/ton. For cationic polymers based on carbohydrates, such as cationic starch and cationic guar gum, amounts of at least 0.05 kg/ton, calculated as dry on dry fibers and optional fillers, are usually used. For these polymers the amounts are suitably from 0.1 to 30 kg/ton and preferably from 1 to 15 kg/ton.

The improved retention and dewatering effect with the system of the invention can be obtained over a broad stock pH range. The pH can be within the range from about 3 to about 10. The pH is suitably above 3.5 and preferably within the range of from 4 to 9.

The process according to the invention can be used for producing cellulose fiber containing products in sheet or web form such as for example pulp sheets and paper. It is preferred that the present process is used for the production of paper. The term "paper" as used herein of course include not only paper and the production thereof, but also other sheet or web-like products, such as for example board and paperboard, and the production thereof.

The process according to the invention can be used in the production of sheet or web-like products from different types of suspensions containing cellulosic fibers and the suspensions should suitably contain at least 50% by weight of such fibers, based on dry substance. The suspensions can be based on fibers from chemical pulp, such as sulphate and sulphite pulp, thermomechanical pulp, chemo-thermomechanical pulp, refiner pulp or groundwood pulp from both hardwood and softwood, and can also be used for suspensions based on recycled fibers. The suspension can also contain mineral fillers of conventional types, such as for example kaolin, titanium dioxide, gypsum, talc and both natural and synthetic calcium carbonates. The stock can of course also contain papermaking additives of conventional types, such as wet-strength agents, stock sizes based on rosin, ketene dimers or alkenyl succinic anhydrides, and the like. The present invention makes it possible to improve the retention of such additives, which means that further benefits can be obtained, for example improved sizing and wet strength of the paper.

The invention is further illustrated in the following Examples which, however, are not intended to limit same. Parts and % relate to parts by weight and % by weight, respectively, unless otherwise stated.

EXAMPLE 1

In the following tests the dewatering effect was evaluated by means of a Canadian Standard Freeness (CSF) Tester, which is the conventional method for characterizing dewatering or drainage capability according to SCAN-C 21:65.

The stock used was based on 60:40 bleached birch/pine sulphate to which 0.3 g/l of $Na_2SO_4.10H_2O$ was added. Stock consictency was 0.3% and pH 7.0. Additions of chemicals were made to a baffled Britt Dynamic Drainage Jar with a blocked outlet at a stirring speed of 1000 rpm. Without addition of chemicals the stock showed a freeness of 280 ml. In the tests, use was made of a cationic polymer, Raisamyl 142, which is a conventional medium-high cationized starch having a degree of substitution of 0.042, hereafter designated CS, which was added to the stock in an amount of 10 kg/ton, calculated as dry on dry stock system. When adding solely CS to the stock a freeness of 280 ml was obtained. The aluminum compound used was sodium aluminate, hereafter designated NaAl, which was added to the stock in amounts defined below, calculated as $Al_2O_3$ per ton of dry stock system. The anionic organic material used was a silica sol of the type disclosed in U.S. Pat. No. 4,388,150. The sol was alkali-stabilized to a molar ratio of $SiO_2$:$Na_2O$ of about 40 and contained silica particles with a specific surface area of about 500 $m^2/g$, hereafter designated P1. The anionic inorganic particles were added to the stock in amounts defined below, calculated as dry per ton of dry stock system.

The process according to the invention was carried out by adding the cationic polymer to the stock followed by stirring for 30 seconds, adding the pre-mix to the stock followed by stirring for 15 seconds, and then transferring the stock to the CSF Tester. The pre-mix used was prepared by feeding an aqueous stream of the aluminum compound containing 0.5% by weight of $Al_2O_3$ and an aqueous stream of anionic inorganic particles containing 0.5% by weight of particles to a mixing device equipped with two inlets and one outlet. In the mixing device the separate streams were intimately mixed whereupon the resultant stream was introduced into the stock. The streams of the pre-mix were brought into contact for less than about 5 seconds prior to addition to the stock.

Comparisons tests were conducted by adding the first component+second component+third/last component to the stock during 45 seconds with stirring following each addition, and with stirring for 15 seconds following the last addition, and then the stock was transferred to the CSF Tester. The components are defined in Table 1.

TABLE 1

| Test No | Order of adding the components | NaAl kg/ton | P1 kg/ton | CSF ml |
|---|---|---|---|---|
| 1 | NaAl + CS + P1 | 0.2 | 1.0 | 635 |
| 2 | NaAl + CS + P1 | 0.3 | 1.0 | 635 |
| 3 | CS + NaA1 + P1 | 0.3 | 1.0 | 635 |
| 4 | CS + P1 + NaAl | 0.3 | 1.0 | 630 |
| 5 | CS + Pre-mix | 0.2 | 1.0 | 650 |
| 6 | CS + Pre-mix | 0.3 | 1.0 | 655 |

As is evident from Table 1, the process utilizing a pre-mix of sodium aluminate and silica-based particles according to the invention improved the dewatering over Tests 1 to 4 in which the components were separately added to the stock.

EXAMPLE 2

In this Example, the procedure according to Example I was followed in order to test a sol of silica-based particles of the type disclosed in U.S. Pat. No. 5,368,833. The sol had an S-value of about 25% and contained silica particles with a specific surface area of about 900 $m^2/g$ which were surface-modified with aluminum to a degree of 5%. This type of particles is designated P2.

TABLE 2

| Test No | Order of adding the components | NaAl kg/ton | P2 kg/ton | CSF ml |
|---|---|---|---|---|
| 1 | NaAl + CS + P2 | 0.1 | 1.0 | 670 |
| 2 | NaAl + CS + P2 | 0.2 | 1.0 | 675 |
| 3 | NaAl + CS + P2 | 0.3 | 1.0 | 675 |
| 4 | CS + Pre-mix | 0.1 | 1.0 | 685 |
| 5 | CS + Pre-mix | 0.2 | 1.0 | 695 |
| 6 | CS + Pre-mix | 0.3 | 1.0 | 695 |

As can be seen from Table 2, the dewatering effect was improved when applying the pre-mix process of this invention.

EXAMPLE 3

In this Example, the procedure according to Example 1 was followed in order to test a suspension of the type disclosed in International Patent Publication WO 94/05595. The suspension contained silica-based particles of the type P2 according to Example 2 and natural bentonite in a weight ratio of 2:1. This type of particles is designated P3.

TABLE 3

| Test No | Order of adding the components | NaAl kg/ton | P3 kg/ton | CSF ml |
|---|---|---|---|---|
| 1 | NaAl + CS + P3 | 0.2 | 1.0 | 590 |
| 2 | NaAl + CS + P3 | 0.3 | 1.0 | 595 |
| 3 | CS + NaAl + P3 | 0.3 | 1.0 | 585 |
| 4 | CS + Pre-mix | 0.2 | 1.0 | 615 |
| 5 | CS + Pre-mix | 0.3 | 1.0 | 620 |

The process according to the present invention showed improved drainage over Tests 1 to 3 in which the components were separately added to the stock.

EXAMPLE 4

In this Example, a comparison was made in a manner similar to Example 1 except that polyaluminum chloride, designated PAC, was used as the aluminum compound and polysilicic acid was used as the anionic inorganic particles. The polysilicic acid was prepared by acidification of a sodium silicate solution having a molar ratio of $Si_2O:Na_2O$ of 3.5:1 and $SiO_2$ content of 5.5% by weight to a pH of about 2.5 by means of a cation exchange resin saturated with hydrogen ions. The obtained polysilicic acid was aged for about 30 hours and then diluted with deionized water to a concentration of 0.5% by weight of $SiO_2$. The polysilicic acid so formed had a specific surface area of 1200 $m^2/g$ and is hereafter designated P4.

The stock used in this Example was prepared from the stock according to Example 1 to which chalk was added in an amount of 30%, based of dry fibers. The stock so obtained had a pH of 7.5 and showed a freeness of 330 ml. The solution of aluminum compound contained 0.25% by weight of $Al_2O_3$ and the amount of aluminum compound added to the stock was calculated as $Al_2O_3$ per ton of dry stock system.

TABLE 4

| Test No | Order of adding the components | PAC kg/ton | P4 kg/ton | CSF ml |
|---|---|---|---|---|
| 1 | CS + P4 | — | 1.0 | 535 |
| 2 | CS + PAC + P4 | 0.25 | 1.0 | 595 |
| 3 | PAC + CS + P4 | 0.25 | 1.0 | 570 |
| 4 | PAC + CS + P4 | 0.33 | 1.0 | 580 |
| 5 | CS + Pre-mix | 0.16 | 1.0 | 600 |
| 6 | CS + Pre-mix | 0.25 | 1.0 | 620 |
| 7 | CS + Pre-mix | 0.25 | 1.5 | 615 |
| 8 | CS + Pre-mix | 0.33 | 1.0 | 605 |

The pre-mix process according to the invention showed improved effect over the process with separate additions.

EXAMPLE 5

In this Example, the procedure according to Example 4 was followed except that the aluminum compound used was alum.

TABLE 5

| Test No | Order of adding the components | Alum kg/ton | P4 kg/ton | CSF ml |
|---|---|---|---|---|
| 1 | Alum + CS + P4 | 0.33 | 1.0 | 600 |
| 2 | CS + Alum + P4 | 0.33 | 1.0 | 590 |
| 3 | CS + Pre-mix | 0.23 | 1.0 | 610 |

TABLE 5-continued

| Test No | Order of adding the components | Alum kg/ton | P4 kg/ton | CSF ml |
|---|---|---|---|---|
| 4 | CS + Pre-mix | 0.29 | 1.0 | 615 |
| 5 | CS + Pre-mix | 0.35 | 1.0 | 620 |

As is evident from the Table, the pre-mix process resulted in improved dewatering.

EXAMPLE 6

In this Example, the procedure according to Example 4 was essentially followed except that the aluminum compound used was sodium aluminate. The process of the invention was further compared with a process disclosed in U.S. Pat. Nos. 4,927,498 and 5,176,891 using a polyaluminosilicate. The polyaluminosilicate was prepared by adding a sodium aluminate solution containing 2.5% by weight of $Al_2O_3$ to 1% by weight of aqueous polysilicic acid, prepared and aged as described in Example 4, to give a molar ratio of $Al_2O_3$ to $SiO_2$ of 13:87, whereupon the product was diluted to a concentration of 0.5% by weight. This product is designated PAS. The time from bringing the sodium aluminate solution and aqueous polysilicic acid into contact followed by dilution to introducing the product so formed into the stock was 10 minutes. In Table 6, molar ratio refers to molar ratio of $Al_2O_3$ to $SiO_2$.

TABLE 6

| Test No | Order of adding the components | Molar ratio | PAS kg/ton | NaAl kg/ton | P4 kg/ton | CSF ml |
|---|---|---|---|---|---|---|
| 1 | NaAl + CS + P4 | 20:80 | | 0.25 | 1.0 | 560 |
| 2 | CS + NaAl + P4 | 20:80 | | 0.25 | 1.0 | 580 |
| 3 | CS + PAS | 13:87 | 1.08 | | | 580 |
| 4 | CS + Pre-mix | 13:87 | | 0.08 | 1.0 | 610 |
| 5 | CS + Pre-mix | 13:87 | | 0.16 | 1.0 | 640 |
| 6 | CS + Pre-mix | 13:87 | | 0.25 | 1.5 | 650 |
| 7 | CS + Pre-mix | 20:80 | | 0.25 | 1.0 | 645 |
| 8 | CS + Pre-mix | 25:75 | | 0.33 | 1.0 | 630 |

Pre-mixing sodium aluminate and polysilicic acid according to the present process provided improved dewatering in comparison with the process using separate additions as well as the process using polyaluminosilicate.

We claim:

1. A process for the production of paper which comprises a) providing an aqueous suspension containing cellulose fibers and optional fillers;

b) adding to said suspension i) at least 0.05 kg/ton, calculated as dry polymer on dry fibers and optional fillers, of cationic starch, ii) at least 0.001 kg/ton, calculated as $Al_2O_3$ based on dry fibers and optional fillers of an aluminum compound selected from the group consisting of alum, aluminates, aluminum chloride, aluminum nitrate, polyaluminum compounds and mixtures thereof, iii) at least 0.01 kg/ton, calculated as dry particles on dry fibers and optional fillers of anionic inorganic particles, wherein said aluminum compound and said anionic inorganic particles are mixed immediately prior to being added to said suspension and wherein said anionic inorganic particles are selected from the group consisting of colloidal silica, polysilicic acid, colloidal aluminum-modified silica having a specific surface area up to 1000 $m^2/g$, bentonite, and mixtures thereof and;

c) forming and draining the obtained suspension on a wire.

2. The process of claim 1, wherein the aluminum compound is mixed with the anionic inorganic particles less than 1 minute before adding the resultant mixture to the suspension.

3. The process of 1, wherein an aqueous stream of the aluminum compound is brought into contact with an aqueous stream of the anionic inorganic particles and the resulting aqueous stream is introduced into the suspension.

4. The process of claim 1, wherein the aluminum compound is alum, aluminate, aluminum chloride, aluminum nitrate, polyaluminum chloride, polyaluminum sulphate, polyaluminum chloride containing sulphate or polyaluminum silicate-sulphate.

5. The process of claim 1, wherein the anionic inorganic particles are colloidal silica, polysilicic acid or colloidal aluminum-modified silica.

6. The process of claim 5, wherein the anionic inorganic particles are colloidal silica or colloidal aluminum-modified silica, the particles having a specific surface area within the range of from 50 to 1000 $m^2/g$.

7. The process of claim 5, wherein the anionic inorganic particles are polysilicic acid with a specific surface area within the range of from 1000 to 1700 $m^2/g$.

8. The process of claim 1, wherein the anionic inorganic particles originate from a silica sol having an S-value within the range of from 8 to 45% containing silica particles with a specific surface area within the range from 750 to 1000 $m^2/g$, the particles being aluminum-modified to a degree of from 2 to 25%.

9. The process of claim 1, wherein the anionic inorganic particles are silica based particles and bentonite.

10. The process of claim 1, wherein the weight ratio of anionic inorganic particles to aluminum compound is within the range of from 100:1 to 1:1.

11. The process of claim 1, wherein the anionic inorganic particles are added in an amount of from 0.05 to 5 kg/ton, calculated as dry particles on dry fibers and optional fillers.

12. The process of claim 1, wherein the aluminum compound is added in an amount of from 0.01 to 1 kg/ton, calculated as $Al_2O_3$ based on dry fibers and optional fillers.

13. The process of claim 1, wherein cationic starch is added to the suspension in an amount from 1 to 15 kg/ton, calculated as dry on dry fibers and optical fillers.

14. The process of claim 1, wherein the suspension comprises filler.

15. The process of claim 14 wherein the suspension contains a calcium carbonate filler.

16. A process for the production of paper comprising (a) providing a suspension containing cellulosic fibers and optional fillers;

(b) adding to said suspension (i) an organic polymer drainage and/or retention aid selected from cationic starch, the organic polymer being added to said suspension in an amount of at least 0.005 kg/ton, calculated as dry polymer on dry fibers and optional fillers, (ii) at least 0.001 kg/ton, calculated as $Al_2O_3$ based on dry fibers and optional fillers of an aluminum compound selected from the group consisting of alum, aluminates, aluminum chloride, aluminum nitrate, polyaluminum compounds and mixtures thereof, and (iii) and at least 0.01 kg/ton of anionic silica-based particles having a specific surface area from 50 to 1000 $m^2/g$, the amount of silica-based particles added calculated as $SiO_2$ on dry fibers and optional fillers, said aluminum compound and said silica-based particles being mixed immediately prior to addition to said suspension; and (c) forming and draining the obtained suspension on a wire to form paper.

17. The process of claim 16, wherein the silica-based particles have a specific surface area of from 100 $m^2/g$ to 950 $m^2/g$.

18. A process for the production of paper comprising (a) providing a suspension containing cellulosic fibers and optional fillers;

(b) adding to said suspension (i) as an organic polymer drainage and/or retention aid, cationic starch, the cationic starch being added to said suspension in an amount of at least 0.05 kg/ton, calculated as dry polymer on dry fibers and optional fillers, (ii) at least 0.001 kg/ton, calculated as $Al_2O_3$ based on dry fibers and optional fillers of an aluminum compound selected from the group consisting of alum, aluminates, aluminum chloride, aluminum nitrate, polyaluminum compounds and mixtures thereof, and (iii) at least 0.01 kg/ton of a polysilicic acid having a specific surface area above about 1000 $m^2g$, calculated as $SiO_2$ on dry fibers and optional fillers, wherein an aqueous stream of the aluminum compound is brought into contact with an aqueous stream of the polysilicic acid and the resulting aqueous stream is essentially immediately introduced into the suspension; and (c) forming and draining the obtained suspension on a wire to form paper.

* * * * *

UNITED STATES PATENT AND TRADEMARK OFFICE

CERTIFICATE OF CORRECTION

PATENT NO. : 5,846,384

DATED : December 8, 1998

INVENTOR(S) : Schold, Z., et al.

It is certified that error appears in the above-identified patent and that said Letters Patent is hereby corrected as shown below:

Column 10, line 7, after "of"(first occurrence) insert --claim--.

Signed and Sealed this

Sixteenth Day of March, 1999

*Attest:*

Q. TODD DICKINSON

*Attesting Officer*

*Acting Commissioner of Patents and Trademarks*